US005326093A

United States Patent [19]

Sollitt

[11] Patent Number: 5,326,093

[45] Date of Patent: Jul. 5, 1994

[54] UNIVERSAL INTERFACE MODULE INTERCONNECTING VARIOUS COPIERS AND PRINTERS WITH VARIOUS SHEET OUTPUT PROCESSORS

[75] Inventor: Thomas E. Sollitt, Fairport, N.Y.

[73] Assignee: Xerox Corporation, Stamford, Conn.

[21] Appl. No.: 66,385

[22] Filed: May 24, 1993

[51] Int. Cl.[5] ..... B65H 29/20

[52] U.S. Cl. ..... 271/306; 271/300; 271/302; 271/902

[58] Field of Search ..... 271/902, 200, 296, 300, 271/302, 306

[56] References Cited

U.S. PATENT DOCUMENTS

| | | | |
|---|---|---|---|
| 2,490,381 | 12/1949 | Shields | 198/88 |
| 3,071,237 | 1/1963 | Powell | 198/91 |
| 3,765,670 | 9/1972 | Johnson | 271/296 |
| 3,848,867 | 11/1974 | Johnson | 271/173 |
| 3,853,314 | 12/1994 | Anderson | 271/173 |
| 3,866,904 | 2/1975 | Stemmle | 271/173 |
| 3,944,217 | 3/1976 | Greene et al. | 271/173 |
| 3,963,235 | 6/1976 | Snellman et al. | 271/64 |
| 4,322,069 | 3/1982 | Mitchell | 271/296 |
| 4,353,543 | 10/1982 | Ikeda et al. | 271/306 |
| 4,515,458 | 5/1985 | Masuda et al. | 355/3 SH |
| 4,548,403 | 10/1985 | Matsui et al. | 271/296 |
| 4,580,775 | 4/1986 | Maruyama | 271/293 |
| 4,602,775 | 7/1986 | Calhoun et al. | 270/55 |
| 4,615,521 | 10/1986 | Mori | 271/264 |
| 4,671,505 | 6/1987 | Hidaka | 271/293 |
| 4,691,914 | 9/1987 | Lawrence | 271/297 |
| 4,700,940 | 10/1987 | King | 270/58 |
| 4,828,415 | 5/1989 | Hirono et al. | 400/605 |
| 4,830,356 | 5/1989 | Zoltner | 271/226 |
| 4,881,730 | 11/1989 | Kaneko | 271/296 |
| 4,900,009 | 2/1990 | Kitahura et al. | 271/296 |
| 4,913,426 | 4/1990 | Kaneko | 271/296 |
| 5,078,385 | 1/1992 | Serita | 271/296 X |
| 5,099,274 | 3/1992 | Mirlieb et al. | 355/27 |
| 5,101,241 | 3/1992 | Watanabe | 355/323 |
| 5,145,168 | 9/1992 | Jonas et al. | 271/234 |
| 5,172,162 | 12/1992 | Taneda | 355/202 |
| 5,172,908 | 12/1992 | Steinhilber | 271/288 |
| 5,222,730 | 6/1993 | Miyake | 271/296 X |

FOREIGN PATENT DOCUMENTS

| | | | |
|---|---|---|---|
| 3718131 | 12/1988 | Fed. Rep. of Germany | B65H 5/04 |
| 201767 | 9/1987 | Japan | 271/296 |

*Primary Examiner*—Richard A. Schacher

[57] ABSTRACT

A universal interface for operatively connecting and feeding the sequential copy sheet output of various reproduction machines of widely varying ranges of sheet output level heights to various independent copy sheet processing units having widely varying sheet input level heights with a free-standing movable interface module of a fixed narrow width. A sheet feeding path extends from one side of the module to the other for transporting the copy sheets. This sheet feeding path is preferably bi-directional and reversible for feeding copy sheets therethrough from either side. It is repositionable by vertically repositioning over a large vertical height range integral sheet path ends opening at opposite sides of the interface module, a retention system retains the sheet path ends at a selected height position mating with a selected reproduction apparatus sheet output level and a selected copy sheet processing unit sheet input level. The disclosed sheet feeding path varies in length automatically with this path end repositioning, yet remains substantially linear, and may utilize baffles telescoping automatically.

9 Claims, 6 Drawing Sheets

UNIVERSAL INTERFACE MODULE INTERCONNECTING VARIOUS COPIERS AND PRINTERS WITH VARIOUS SHEET OUTPUT PROCESSORS

Cross-reference and incorporation by reference is made to copending, commonly assigned, U.S. application Ser. Nos. 08/054,943 by Barry P. Mandel and Richard A. Van Dongen, entitled "Mailbox/Compiler Architecture", Attorney Docket No. D/92332Q, and 08/054,502 by Barry P. Mandel and David R. Kamprath, entitled "Shared User Printer Output Dyanmic 'Mailbox' System", Attorney Docket No. D/92332; both filed Apr. 27, 1993.

The disclosed modular interconnect device provides a simple but wide-range independent adjustment of its sheet input and output heights or levels, and repositioning inter-connecting sheet path, to operatively connect between almost any existing or future printed sheet output and sheet processing units, irrespective of the sheet input and output heights or levels of those units. It is thus referred to herein a "Universal Interface (or transition) Module" or "UIM". In particular, the subject UIM provides a paper path sheet transport between almost any reproduction apparatus and almost any finisher or other sheet processing apparatus, irrespective of wide variation or differences in their sheet output and input levels or direction.

By way of background, there are a large number of copiers and printers on the market and on the drawing board today that are at different paper path heights and directions for input and output. Customers are desirous of greater compatibility with various commercial feeding/finishing equipment providing more on-line sheet processing options, with less manual sheet handling. In the past, some copier designs called for the output sheets to be delivered at a "standard" output height and side for that particular supplier, but often without regard to potential downstream equipment, leaving the task of delivering that sheet output to that other downstream device as the responsibility of that particular paper handling accessory equipment supplier [of which there are more than 24 multi-nationally]. Also, the sheet feeding rates (in copies per minute, or cm. per second) are often not compatible. The number of possible combinations is staggering. Although a "standard" paper path height agreement at 860 mm (measured from the floor) with some finishing suppliers has been proposed, even if accepted, that could undesirably force compromise of other copier, printer or finisher design features.

In contrast, this UIM disclosed herein can provide one "standard" transition module to connect with all feeding and finishing partner products, regardless of input/output height or direction. It can provide a significant cost (UMC) reduction by enabling production of only one identical module (and spare parts) in volume quantities, versus many different specialized interconnect transport devices.

Although there is extensive and longstanding patent prior art on various specialized partially variable level copier-to-sorter or internal sorter variable bin level sheet transports, and some patent art on interface modules (examples are cited below), the disclosed UIM system embodiment below provides a single free-standing universal interface module which may be moved in between almost any copier or printer on one side and almost any finisher or other sheet processing accessory on its other side, which UIM provides both input and output level adjustments, independent of one another, over ranges mating to almost any such respective devices, as well as an automatic internal sheet feeding path length adjustment allowing that independent input and output level change, which automatic path length adjustment is inside this stand-alone module, yet which module can desirably have a defined (fixed) narrow width, so as not to add significant customer space usage or overall length to combined equipment, and have predictable dimensions for any customer usage.

The exemplary UIM apparatus disclosed in the example hereinbelow provides a telescoping paper path through the UIM that automatically adjusts in length as the selected sheet input and output levels are varied, without requiring any changes in the dimensions of the UIM itself, and yet remains desirably planar and provides positive sheet feeding, irrespective of changes in the UIM input and/or output level.

An additional feature disclosed in the embodiments below is to provide a single modular UIM optionally enabling either left or right printer exit commonality. I.e., the ability to accept sequential sheet output from either right-exit or left-exit printers.

The disclosed universal interface unit can desirably be a free-standing movable stand-alone unit that is relatively low cost and light weight and very compact, that may be attached to, or even simply moved next to, to dock or mate with, the output of almost any conventional copier or printer, including facsimile or combination (plural mode) machines, or networked electronic mail printers, or almost any such other reproduction apparatus, even desk-top or cart-mounted units on various levels of desks or carts.

The exemplary disclosed UIM internal sheet path may also desirably provides a variable speed but positive sheet feeding drive system that can provide automatic speed matching between various interconnected units or modules. This same UIM sheet path drive may also provide reversibility, for left or right side input and output.

A specific feature of the specific embodiment(s) disclosed herein is to provide a universal interface for operatively connecting and feeding the sequential copy sheet output of various selectable reproduction machines of widely varying ranges of sheet output level heights to various selectable independent copy sheet processing units having widely varying sheet input level heights, comprising: a free-standing movable universal interface module of a fixed narrow width; said narrow free-standing universal interface module providing a repositionable sheet feeding path therethrough, from one side to the other of said module, for transporting said copy sheet output of said selected reproduction apparatus to said sheet input of said selected copy sheet processing module; said repositionable sheet feeding path through said universal interface module providing selectably reversible feeding of said copy sheets therethrough in either direction; said repositionable sheet feeding path through said universal interface module including integral vertically repositionable sheet receiving or sheet discharging sheet path ends opening at opposite sides of said interface module, which sheet path ends are readily independently repositionable over a large vertical height range; a retention system for retaining said sheet path ends at selected height positions mating with a selected reproduction apparatus sheet output level and a selected copy sheet processing unit sheet input level so that said repositionable sheet feeding path is operatively connecting therebetween to feed sheets from said reproduction apparatus to said copy sheet processing module.

Further specific features disclosed herein, individually or in combination, include those wherein said repositionable sheet feeding path has a variable path length varied automatically with said path ends vertical height repositioning, and/or wherein said sheet feeding path through said interface module remains substantially linear irrespective of said sheet path ends vertical height repositioning, and/or wherein said universal interface module has a constant width of less than about 40 cm, and/or wherein at least one of said sheet path ends of said interface module sheet feeding path is vertically repositionable over a vertical height range of at least approximately 50 to 100 cm, and/or wherein said sheet path ends of said interface module sheet feeding path are vertically repositionable over a vertical height range of at least approximately 50 to 100 cm, and/or wherein said repositionable sheet feeding path comprises a variable speed sheet feed drive automatically adjusting to sheet input speed, and/or wherein said sheet feeding path has an automatically reversing sheet feed drive, and/or wherein said repositionable sheet feeding path has a variable path length varied automatically with said path ends vertical height repositioning and wherein said sheet feeding path is defined by telescoping baffles automatically telescoping to provide changes in said sheet feeding path length, and/or wherein said sheet feeding path has a path length varying automatically with said path end height repositioning, and wherein said sheet feeding path through said interface module remains substantially linear irrespective of said sheet path end height repositioning, and wherein said sheet feeding path includes telescoping baffles automatically telescoping to provide said path length variations.

Of particular background interest on the general subject of interface modules is Fuji Xerox Corp. U.S. Pat. No. 5,172,162 issued Dec. 15, 1992, filed Dec. 10, 1990. Col. 2, lines 29–44 of this 5,172,162 patent incidentally acknowledges the problem of printer/accessory unit height incompatability addressed herein. However, that patent does not provide any actual teaching of any solution to that problem. [This patent primarily addresses possible internal sheet handling features within such an interface module, such as a purging system .]

The following additional U.S. patents are also noted (with exemplary cites) as disclosing interface modules with sheet transports: Eastman Kodak U.S. Pat. No. 4,602,775 issued Jul. 29, 1986 to L. Calhoun, et al., on a modular unit providing for cover insertion and sheet inversion taking input on one side from a copier and providing output on the other side to a finisher (but at the same level); Xerox Corp. U.S. Pat. No. 5,145,168 issued Sep. 8, 1992 to Jonas, et al. (FIG. 1, interface module 80); U.S. Pat. No. 5,137,270 (D/90287), issued Aug. 11, 1992, entitled "Customer Installable Bypass Sheet Transport With Cover Assembly and Locating Springs"; U.S. Pat. No. 4,602,776, issued Jul. 7, 1986, entitled "Insertion Apparatus for use with Copier/-Sorter System" (inserter module 45); U.S. Pat. No. 4,830,356, issued May 16, 1989, entitled "Passive 'Pinwheel' Copy Sheet Rotator" (module 70 in FIG. 7); U.S. Pat. No. 4,353,543, issued Oct. 12, 1982, entitled "Sorter Connection Apparatus"; U.S. Pat. No. 4,515,458, issued May 7, 1985, entitled "Image Forming Apparatus" (interface unit 103, e.g., Col. 5, lines 22–23); U.S. Pat. No. 3,848,867, issued Nov. 19, 1974, entitled "No-Counter Sorter-Stacker" (interface unit 12); U.S. Pat. No. 4,615,521 to Mori; U.S. Pat. No. 3,963,235 to Snellman et al.; and U.S. Pat. No. 4,700,940 to King.

German Patent application DE 3718-131-A1, "Transfer Jig for Handling Film Sheets" is noted here as of interest structurally for its input/output height adjustments, although it may be seen that this is from a different commercial area. Also, similar U.S. Pat. No. 5,099,274 to Mirlieb et al. (Eastman Kodak). Of course, various other adjustable height conveyors are also known in other non-analogous arts, such as U.S. Pat. No. 2,490,381 on a sack conveyor and U.S. Pat No. 3,071,237 on a pipe conveyor.

Of interest re left or right side sheet input is U.S. Pat. No. 4,691,914 issued Sep. 8, 1987 to F. J. Lawrence (Gradco Systems, Inc.) which discloses a plural bin random access [with plural solenoids] sheet receiver. It discloses sheet input from both the right or left sides, indicated as from a copier and a printer respectively. Xerox Corporation U.S. Pat. No. 3,866,904 issued Feb. 18, 1975 to D. J. Stemmle shows inserting sheets into a set of sorter bins from opposite sides thereof for simplex or duplex copies, respectively for, or without, inversion, but all copies enter from one side of the sorter module. Mita 5,056,768 is noted reselectable right or left hand printer output.

As noted above, there is also extensive patent prior art on telescoping and/or pivoting input paths inside a sorter or connecting from a copier to the various levels of bins of a vertical bin array sorter, and/or from variable copier input heights. Examples include: U.S. Pat. Nos. 3,853,314; 3,963,235; 3,944,217; 4,615,521; 4,700,940; 5,099,274; 4,322,069; 4,548,403; 4,580,775; 4,671;505; 4,828,415; 4,881,730; 4,900,009; 4,913,426; 5,101,241 and 5,172,908.

One optional output device connected to or by the UIM can be a "mailbox" unit. "Mailboxes" can provide discrete bins for received hard copies of several different job recipients of shared user printers, as more fully explained in the cross-referenced applications of the first paragraph above, and references cited therein. Mailbox units may include locked "privacy doors" for certain designated bins which may have electronically controlled bin unlocking, for private bin security. A mailbox output unit allows plural recipients to share the same printer and/or facsimile or the like receiver, without disclosing, compromising or commingling their separate jobs and/or correspondence. A stand-alone "mailbox" or addressable sorter can automatically sort and file various output documents ("hard copies", i.e., physical sheets) in discrete designated bins, which can optionally be secured.

"Mailbox" bins or other stackers desirably can store plural finished or bound (e.g. stapled) sets in one or more selected assigned mailbox bins. Thus, any particular user-designated bin can store plural stapled sets from the same or different jobs. Noted in this regard is Xerox Corporation U.S. Pat. No. 5,098,074 issued Mar. 24, 1992 to Barry P. Mandel, et al (D/88157), especially FIG. 4 and its description, and the last paragraphs, and the corresponding abstracted "Xerox Disclosure Journal" publication Vol. 16, No. 5, pp. 281–283 dated September/October 1991. Also disclosed of interest in said 5,098,074 patent, is a partial (shared with a tray) compiler shelf, tamper, stapler, eject rolls, stack height sensor, and other output systems hardware of interest.

Further noted re partially shared compiler/stackers is Canon U.S. Pat. No. 5,137,265.

The alleged utility of otherwise conventional existing sorters for [unlocked] printer output sorters or "mailboxes", and printer "mailboxing" in general, is briefly discussed in Col. 1 of U.S. Pat. No. 4,843,434 issued Jun. 27, 1989 to F. Lawrence, et al, by Gradco Systems Inc. (see below); U.S. Pat. No. 4,763,892 issued Aug. 16, 1988 to H. Tanaka, et al, and Canon Takahashi et al. U.S. Pat No. 4,051,419, issued Feb. 26, 1985. Of further "mailbox" interest is Seiko Epson Corporation U.S. Pat. No. 5,141,222 issued Aug. 25, 1992 by Shigeru Sawada, et al., (and its equivalent EPO Application No. 0 399 565 "Printer" published Nov. 28, 1990).

Other sheet processing options can include providing enhanced job set finishing functions. For example, stapling and/or other binding, punching, folding, special sheet inserts or booklet making, and stacking or sorting of either finished or unfinished sets. Further art examples are cited hereinbelow.

The present system may optionally be used as a part of office systems for electronic mail hardcopy prints and/or other networked or shared user document prints in general. E.g., in a shared user, networked, printer environment, such as in a modern office environment, the printer can electronically recognize the sender or user terminal sending the printing job from network or document electronic information, such as a "job ticket", already available in or with said electronic job and printing distributions, and process and output the hardcopies accordingly. (Such shared printers may also have alternate scanner or floppy disk document inputs.)

It is additionally noted that combined facsimile and/or other digital scanning or copying, receiving and printing (and even additional conventional light lens, or digital, copying) can be provided in one single unit, encompassed by the term "printer" as used herein. Note, e.g., Xerox Corporation U.S. Pat. No. 4,947,345 filed Jul. 25, 1989 and issued Aug. 7, 1990 to Paradise, et al.; U.S. Pat. No. 3,597,071, filed Aug. 30, 1968 and issued Jul. 27, 1971 to Jones; Fuji Xerox Co. Ltd. U.S. Pat. No. 5,038,218, issued Aug. 6, 1991 to Matsumoto; Sharp U.S. Pat. No. 5,012,892, issued Jun. 4, 1991 to Kita, et al.; and IBM Corp. U.S. Pat. No. 4,623,244, issued Nov. 18, 1986 to D. R. Andrews, et al., originally filed Oct. 4, 1976 (see, e.g., Col. 55). Such plural mode or combination printers are commercially available, e.g., versions of the Xerox Corporation "DocuTech" printing system, the Fuji Xerox Co. Ltd. "Able" TM machine series (Able TM 3311, etc.) [Xerox 3010], the Canon "Navigator", and the Okidata "Doc It" multifunctional ["combo"] product announced Oct. 28, 1992. The latter allegedly provides simultaneous fax, printer, scanner, and copier capabilities, and includes a controller and image processing board that plugs into a user's PC. Faxes are received on the PC's hard disk. Another such multimode unit is the Xerox Corp. "7033" recently announced as a LAN fax server, scanner, copier, LAN print server, and/or digital printer—all in one network-ready unit. This multifunctional and "turnkey" solution integrates various components within a "NetWare TM" environment. A server board can be installed in the "7033" machine to allow a direct connection to the network (via Ethernet or token ring), and the machine can be attached directly to the network (like a network-ready printer), without having to dedicate a PC. The fax software provides shared users access to all of the "7033" terminal's features from their workstations. The fax terminal's software package is named "XPCONSOL" and is a menu-driven software which looks and feels like "PCONSOLE" and likewise, may be used to set up the "7033" as a network print server. The "7033" can handle both addressed and unaddressed incoming faxes. Network workstations can fax from the command line, an application, windows, or the copier-scanner itself. Other new multifuntional units include the Rioch DS5330; and the Cannon GP55 series, also offering optional magneto-optical disk filing.

By way of further background on other output devices (copy sheet processing units), sorters with in-bin set stapling for finishing are well known, e.g., Xerox Corporation U.S. Pat. Nos. 3,884,408 to L. Leiter et al.; 3,944,207 to Bains; 3,995,748 to Looney; 4,687,191 to Stemmle; 4,681,310 to Cooper; and 4,925,171 to Kramer, et al.. Also, Xerox Corporation R/84007 U.K. 2 173 483-A GB published Oct. 15, 1986 by Denis Stemmle; and R/81011 U.S. Pat. No. 4,687,191 issued Aug. 18, 1987 and published in the EPO as 0198970-A1 on Oct. 29, 1986. Also, U.S. Pat. No. 4,083,550 issued Apr. 11, 1978 to R. Pal. Other Xerox Corporation patents include Snellman et al U.S. Pat. No. 4,145,241 and Hamlin et al U.S. Pat. No. 4,564,185 on edge jogging and glue binding sets in a sorter or collator and/or stapling of the post-collated copy sets. Withdrawal of the sets from the respective bins with a gripper extractor and for on-line stapling as in the Xerox Corporation "9900" copier is shown for example in Xerox Corporation U.S. Pat. No. 4,589,804 to Braun et al.; U.S. Pat. No. 4,361,393 to Noto and U.S. Pat. No. 5,024,430 issued Jun. 18, 1991 to Nobuyoshi Seki et al. (Ricoh), which also returns stapled sets to the bin, and has a stapler movable along the array of bins. Other recent Japanese owned patents in this area include U.S. Pat. No. 4,762,312 issued Aug. 9, 1988 to Y. Ushirogatn (Ricoh); Minolta U.S. Pat. No. 4,801,133 issued Jan. 31, 1989; and several Canon patents and EPO patent application publications on in-bin stapling systems such as EP 301-594, 5, and 6-A with Japanese priority app. number 191934 filed Jul. 30, 1987. Also, U.S. Pat. No. 5,125,634 issued Jun. 30, 1992 to Frederick J. Lawrence (Gradco); U.S. Pat. No. 5,131,642 issued Jul. 21, 1992 to Hiroshi Yamamoto (Ikegami Tsushinki) and U.S. Pat. No. 5,150,889 issued Sep. 29, 1992 to Taguchi (Mita). These all provide further examples of finishing devices for copiers.

As may be seen from the above, integral sorter/stapler units with in-bin stapling are well known. Typically, as disclosed, the stapler unit moves or pivots partially into each bin and staples each set therein, or the compiled set is moved slightly out of the bin, stapled and moved back into the bin, or the bin moves or pivots into the stapler unit.

By way of further background, one cannot staple output job sets until after they are collated. Thus, for post-collated copier output, a sorter must fill all the required bins with all the copies of the job before stapling any of them. On the other hand, precollation copying, by using an RDH, or an electronic printer, as also taught in art cited theretofor, allows the job sets to be printed out as pre-collated job sets and delivered as such to an individual bin and finished one set at a time.

As to usable specific or alternative hardware components of the subject UIM apparatus itself, it will be appreciated that, as is normally the case, some such specific hardware components are known per se in other apparatus or applications. For example, various commercially available stand-alone, self-controlled modular sorter units are known for sorting the output of xerographic copiers or printers, with various hardware systems. Examples include above-cited art and its references.

A printer, copier or facsimile or the like reprographic system providing printed sheet output here is encompassed by the terms "printer" or "reproduction machine" herein. In the description herein the term "sheet" or "hard copy" refers to a usually flimsy sheet of paper, plastic, or other such conventional individual physical image substrate, and not to electronic images. Related, e.g., page order, plural sheets, documents or copies can be referred to as a "set" or "job". A "job" may also refer to one or more documents or sets of documents beings sent to or received by a particular addressee or designee. The term "copy sheet" or "output" or "output sheets" herein is still generally used to refer to the paper or other such typical flimsy physical image substrate sheets outputted by a reproduction apparatus, such as a xerographic copier or printer, and whether imaged or printed on one or both sides. These output sheets are now often, of course, not literal "copies" in the old-fashioned sense, since the term now may also encompass computer-generated graphic images (as well as various text) for which there is not necessarily a physical "original" being copied optically or electronically scanned, although that is also encompassed by the term "copy" or "output" sheets here. The term "document", unfortunately, unless defined, is used ambiguously in the art by others to refer to either a single page or multi-page set or job, especially (but not always) as that which being transmitted or copied. "Original" is more specifically used for the latter. "Facsimile", or the common abbreviation "Fax", often refers to conventionally telecommunicated image data, in particular, documents facsimiled via a telephone system in accordance with CCITT Standards, and equipment therefor. However, "facsimile" can also encompass "electronic mail" and/or system or network interconnected printers, networked with remote terminals and/or scanners, and remote printers, or the like, unless indicated otherwise. Plural mode (multi-function) combined normal printing and facsimile message receiver printing capability printers are known, and examples thereof are cited in this specification. Facsimile can be sent and received by "fax cards" in PC's (personal computers or terminals) as well as by conventional stand-alone facsimile machines or combination scanner/fax/printer machines, as noted. The term "printer" encompasses various means for hard copy output from various input sources, including facsimile, and is used here although it often is now used to refer to electronic document images input, versus a light-lens copier to which physical originals must be brought to be imaged. The term "electronic mail" also has various broad meanings, and can include document transmission by internal or external telephone lines, and/or shared or interconnected networks using optical fiber, twisted wire pairs, coaxial cable, wireless transmissions, or other networking media, or combinations thereof, of documents for electronic remote terminal displays and/or printer hard-copy printouts, to any of the numerous addresses designated in the transmitted document.

The following additional partial broad definitions may be helpful to the discussions herein: "Mailbox[ing]": temporarily (or semi-permanently) assigning a unique predetermined electronic address to designated ones of plural bins of a sorter-like output device and enabling a user's output to be directed into a selected bin so assigned. It may or may not include locked bins. Preferably, the user's mailbox output is plural, pre-collated, jobs with all sheets going to a single bin, not requiring sorting. "Sorting": conventionally, this refers to sending one copy sheet of each original page into one bin of a sorter, the next copy sheet of that page into the next bin, etc., repeated for the number of copies, until each of the plural bins required has one copy of the document page, then stacking, one copy sheet of the next original page in each said bin, etc, to compile one collate set in each bin. Thus, job or addressee "mailboxing" is not "sorting" in this common or usual sense of a collating plural identical copy sheets by sequentially placing each sheet in a different bin, and repeating those steps. However, similar "sorter" hardware may be employed in part if it can provide rapid random bin access and other desired features. An overflow bin or general, shared, stacking tray may also desirably be provided, not assigned to any one user. "Stacking": providing the ability to arrange sets of sheets (which may be stapled or otherwise finished sets of sheets), into a well controlled, generally vertical, common stack, although partial "offsetting" of separate job sets may be desirable.

The presently disclosed apparatus may be readily operated and controlled in a conventional manner with conventional control systems. It is well known in general and preferable to program and execute such control functions and logic with conventional software instructions for conventional microprocessors. This is taught by various patents such as U.S. Pat. No. 4,475,156 and art cited therein, and various commercial printers, copiers and sorters. Such software may of course vary considerably depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. Here, control may be quite simple, and may desirably be independent, and in the UIM itself, and/or shared with a controller of a connecting printer or processing unit.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of embodiments thereof, including the drawing figures (approximately to scale) wherein:

FIG. 1 is top internal schematic view of one example of a widely adjustably feed path for a UIM system and unit, for operatively connecting with and receiving the output of copy sheets of a conventional printer, shown by the input arrow. This UIM unit is shown here operating as an interface module receiving sheets at the left hand side for transporting output from the right end or side of the printer apparatus to an exemplary output unit or module the UIM right side, however right side printer output may alternatively be received at the left side of the UIM;

Figure 3:
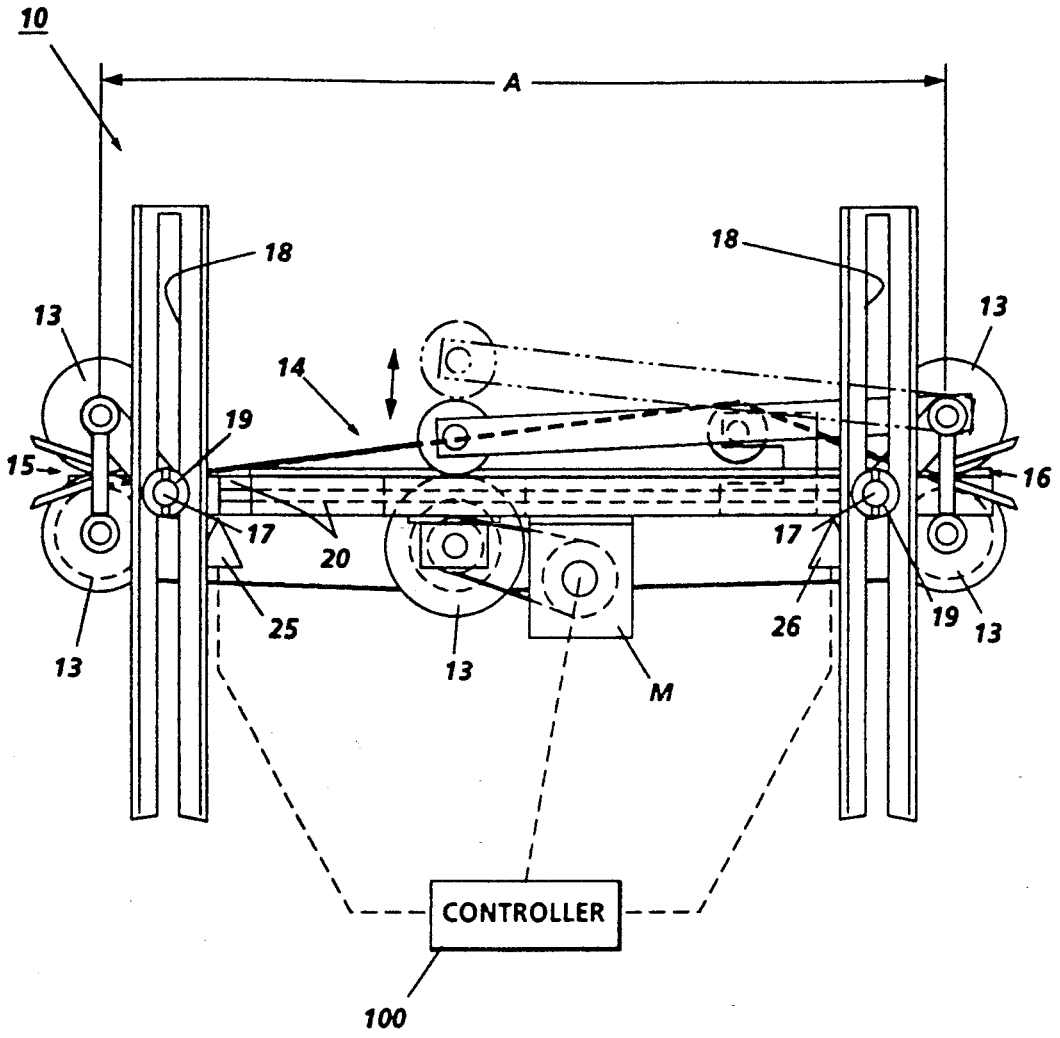
FIG. 3 is a frontal view with the covers removed of the UIM of FIGS. 1 and 2.
Figure 4:
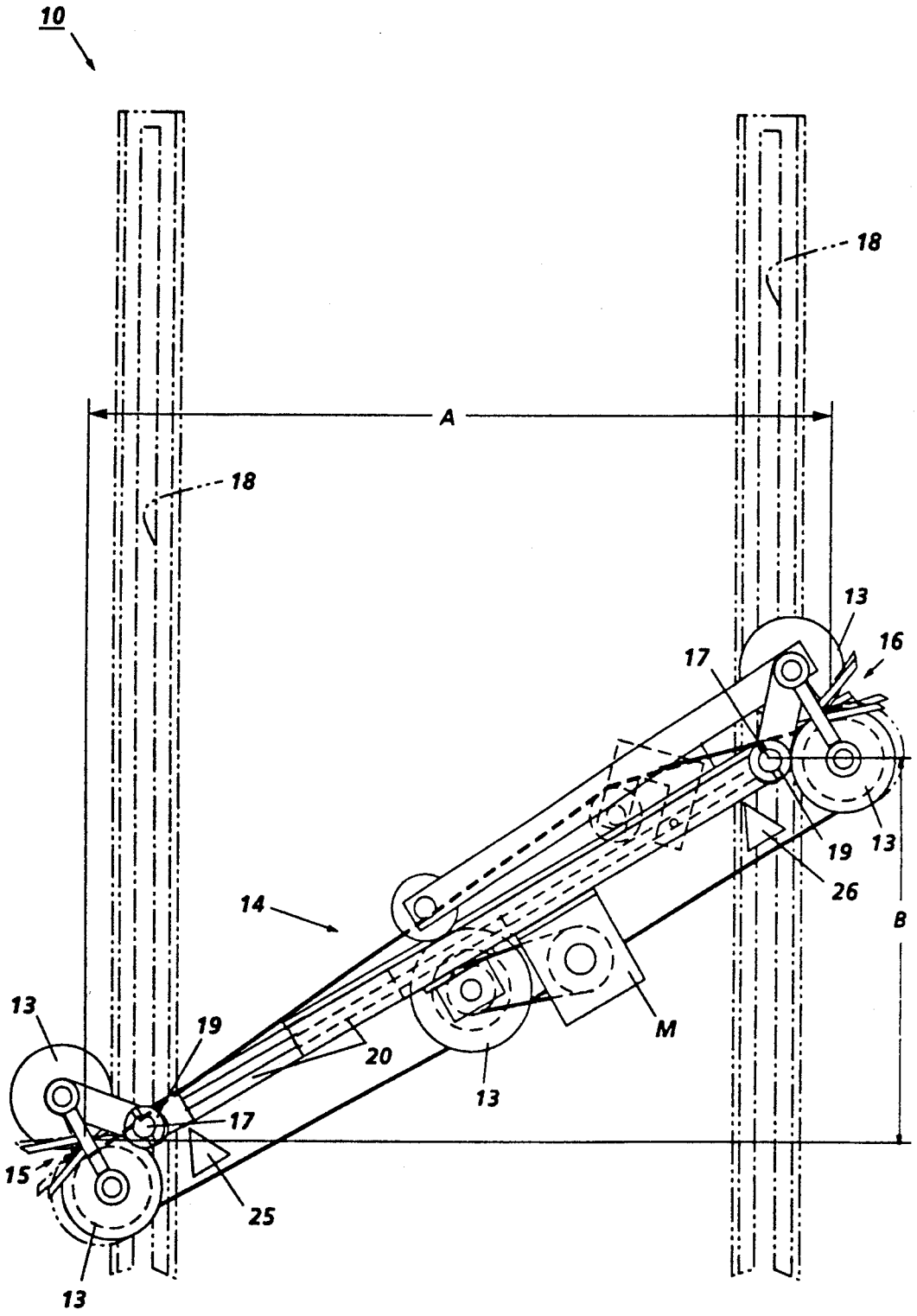
Figure 5:
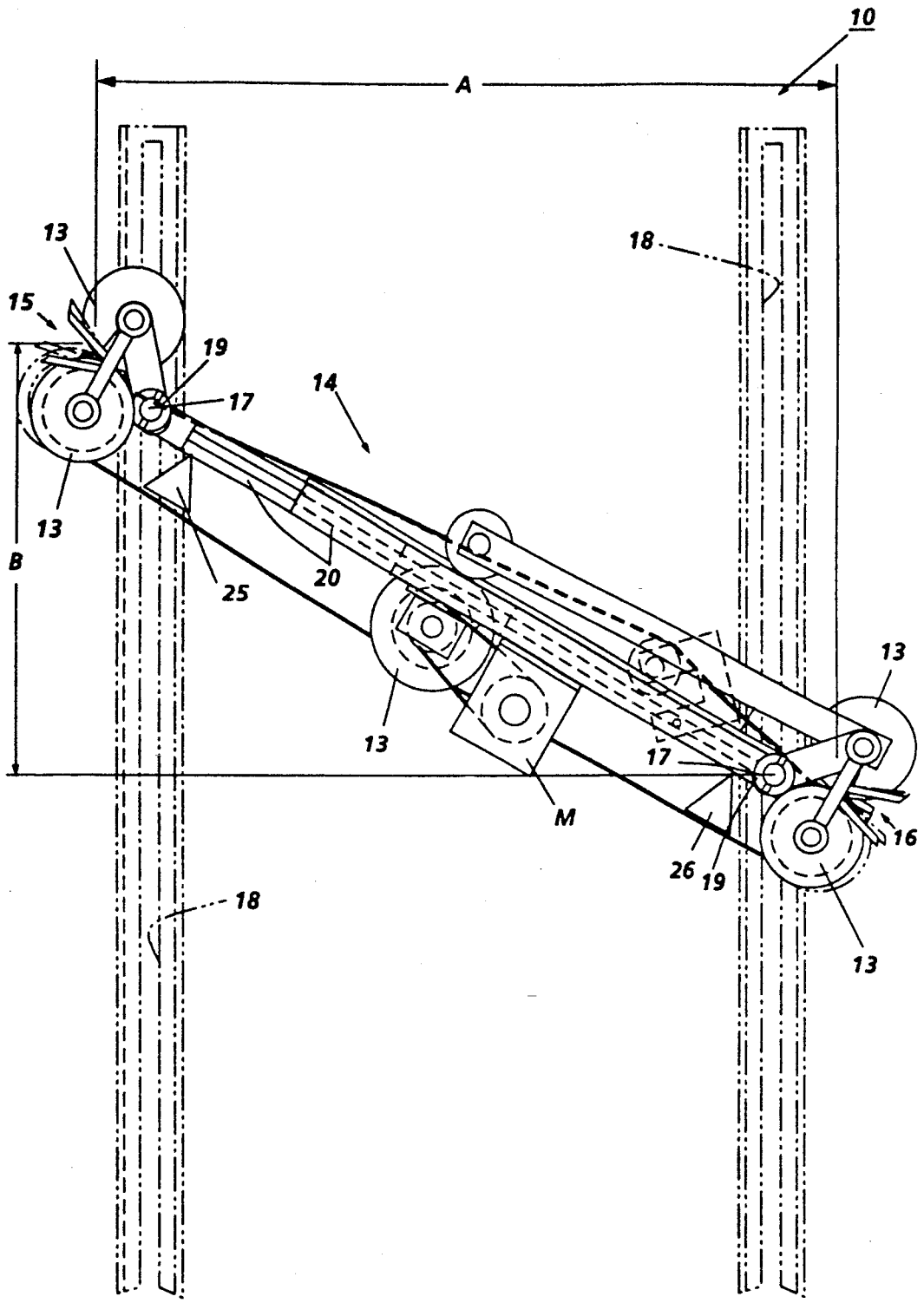
Figure 6:
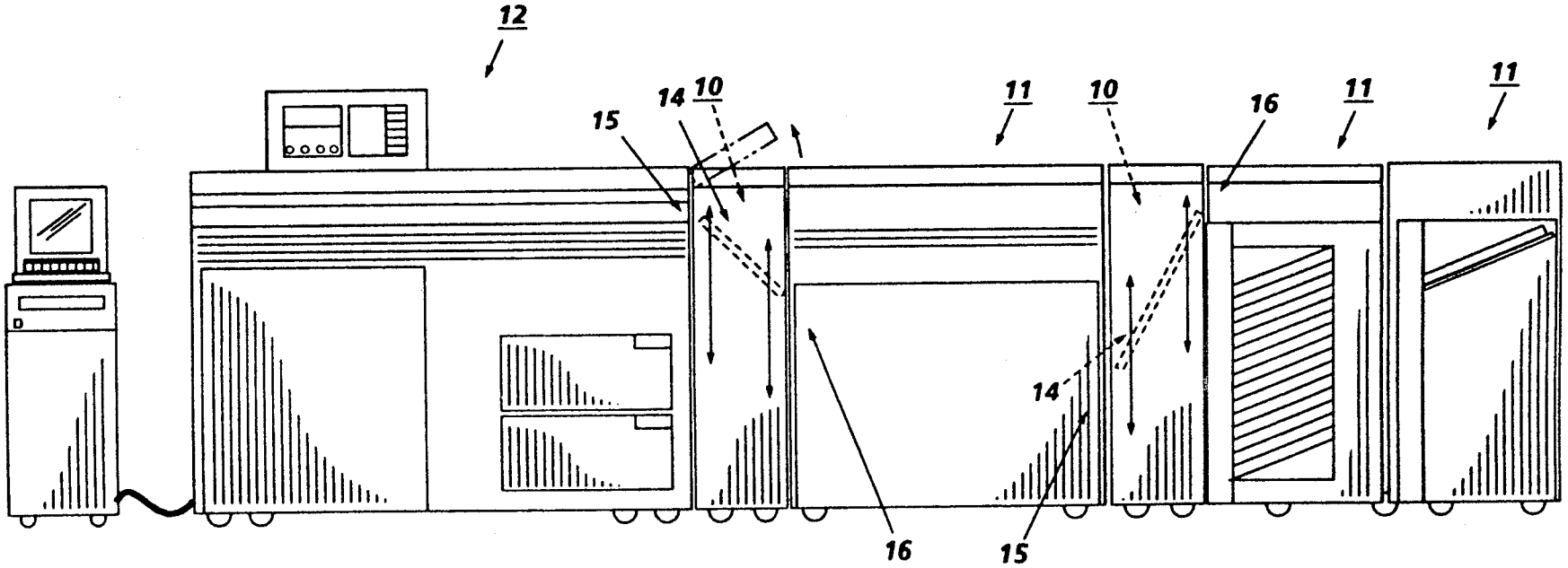

FIGS. 4 and 5 are similar to FIG. 3 (with the support rails in phantom for clarity) but with the feed path shown realigned in two different positions; and FIG. 6 schematically shows a front view of one example of an overall printing and finishing system incorporating said UIM example, illustrating its small effect in the overall size of the combined unit; and also showing an additional said UIM between a finisher module and a mailbox and stacker module.

The disclosed universal interface module or UIM provides a simply but highly adjustable paper path transport that enables processors with widely differing sheet output position levels or heights to interface with a wide variety of other sheet processing units or modules of widely differing input levels or heights. Providing one single highly flexible and adaptable interface unit can eliminate substantial engineering time and work for separate specialized interfaces otherwise needed for a particular printing machine to feed its output sheets a particular third party finisher, sorter, mailbox, folder or other sheet processing unit or module. These units can vary widely in output and input levels. Often the desired input is at the top or bottom, especially for sorters or mailboxes with a typical vertical sheet transport running past a vertical array of bins. The disclosed UIM interconnect module readily provides for a variable input level which may be substantially different from its variable output level, and also provides for the resultant change in the sheet path length through the UIM module.

Turning now to the exemplary embodiment of a UIM 10 shown in the Figures, it will be appreciated that this is merely an example of the claimed system. The printers 12 to which this UIM 10 may be operatively connected is partially shown schematically, since various printers may be so connected, with no printer modifications, as part of various systems. The UIM module or unit adapts or adjusts to various printer output levels to sequentially feed the printer output sheets from the printer into the sheet input entrance of the particular output unit or units 11 currently being used by the customer. The units or systems described herein are merely exemplary. The general reference number 11 will be used throughout for any selected individual output unit, and 12 for any printer (which, as noted, may be a printer, copier, or other reproduction device).

The UIM 10 here provides a linear sheet feeding path 14 therethrough irrespective of its input or output height adjustments. This sheet feeding path 14 here has otherwise conventional frictional sheet feeding nips provided by sheet feeding wheels 13 [or belts] (with opposing idlers) preferably driven by a single reversible motor "M". The sheet path 14 is also defined and supported here by bi-directional generally planar telescoping sheet path baffles 20. These baffles 20 may be made of light weight relatively rigid plastic, or sheet metal. The baffles 20 may extend along one [as shown] or both sides of the sheet path 14. Other than as described herein, sheet path 14 may be generally conventional.

This "universal" interconnecting sheet transport module 10 is preferably a fully enclosed, stand-alone, module on its own wheels, as shown, that can be wheeled into position between any two existing or future sheet reproduction machines and sheet output units to be operatively connected for sheet feeding from one to the other. Connection to a normal a.c. power outlet (or a tap from a connecting unit) for the small motor "M" may be provided. A wire harness carrying DFA interface command/control communications and tachometer feedback for motor speed control may also be provided. All that is required for sheet path interconnection is to simply initially adjust (raise or lower) the input and output ends 15, 16 of the sheet path 14 to set them to the respective output and input level of the respective units to be interconnected. This interconnect module 10 then interconnects the paper paths of the two units, i.e., feeds sheets from the output of one unit to the input of the other unit, irrespective of their levels. As shown, connecting the output of any printer or copier 12 to the input of any selected on-line finisher, sorter or other output accessory 11, to eliminate any operator sheet handling therebetween.

This example UIM 10 provides a desirably simple, linear, through sheet transport path 14 designed to accommodate (adjust to) printer output heights over a range of about 560 mm to 1021 mm, measured from floor level, and comparable adjustability of its output level or height, to be able to mate with almost any known finishing devices and/or sorters or mailboxes. That range was selected by reviewing different equipment level requirements. Thus, this universally adaptable paper path interface module 10 can operatively attach to almost any reproduction unit even though they have individually widely different input and output heights and directions [output ends or sides] to deliver the documents to almost any designated feeding or finishing equipment at a different height. The exemplary system is thus compatible (retrofitable) with almost all existing copiers or printers and also future IOT's with input paper and output document paper path heights anywhere within this selected range from 560 mm (22 inches) to 1021 mm (40 inches) measured from the floor. Of course, this lower range level could be decreased even further if needed, and with a taller UIM, this upper range level can be further increased also.

As noted, this future compatibility permits the design of new machine paper paths without compromise to standard output heights, for substantial savings in development costs, and without limiting the designer's ability to adequately optimize the entire paper path.

Referring further to this example of a simple input and output height adjustability system in this UIM 10, here, input and output path ends or "Y" baffle units, 15, 16 are provided at the opposite ends of the sheet feeding path 14, at opposite sides of the UIM 10. They are not, however, separately called inputs or outputs here, since they can desirably reverse those functions. They are individually adjustable in height independently of one another. These sheet feeding end slot units 15 and 16 in this example are each simply held in place by integral threaded pins 17 that manually slide up and down in slots 18, and are locked in position simply by manual knobs 19 thereon that frictionally hold sheet path 14 ends 15, 16 at their respective selected heights when knobs 19 are rotatably tightened. Alternatively, high friction (brake) tracks may be provided, with no locking system, or toothed vertical tracks with a releasable ratchet engagement.

The path 14 ends 15, 16, may have "Y" or "V" shaped receiving or guiding-in baffles. This helps insure effective intercepting of the upstream incoming sheets, and guiding them into the first path 14 roller 13 nip, especially in those installations in which the angle of inclination of path 14 relative to the connecting unit is severe. Likewise at the path 14 output, to help paper to be directed downstream into the downstream receiving unit nip irrespective of that path connection angle. Optionally, each said "V" or "Y" paper guide or entrance mouth can be designed to adjustably pivot around that respective end roll 13 shaft (e.g., be held in place by a tight fit with the shaft ends), or the baffle 20 end, so that it may be set at a proper or desired angle by the installer or tech rep at installation, when the transport 14 height and angle is set as described herein.

Figure 1:
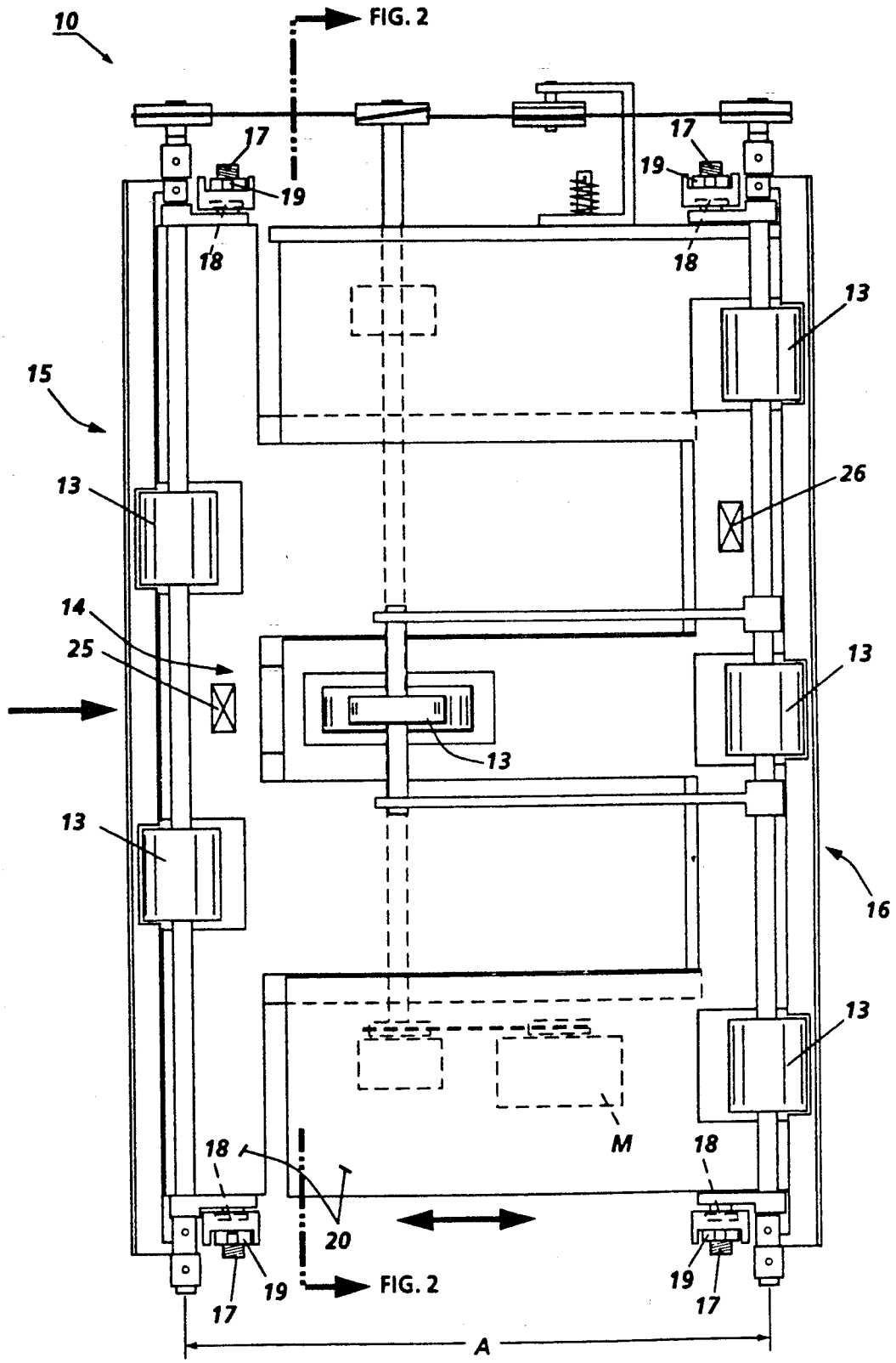
Figure 2:
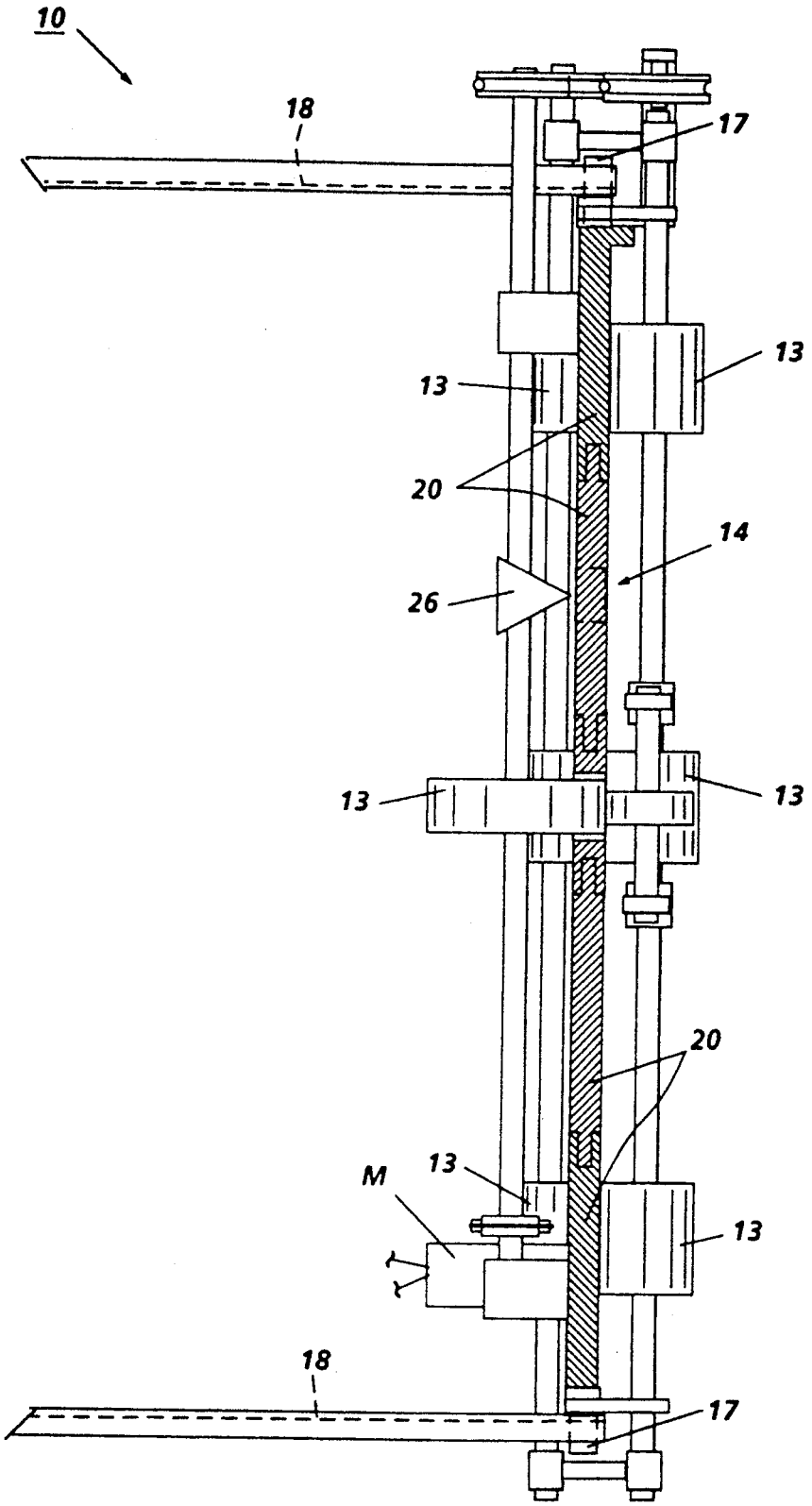
FIG. 2 is a cross-sectional view of the UIM embodiment of FIG. 1 taken through line "FIG. 2" thereof.

This sheet input and/or output 15, 16 vertical repositioning also automatically moves therewith (and extends or contracts) the connecting telescoping baffles 20 of the feed-through path 14. Here, it also moves the sheet path 14 drive rollers 13 and motor M, which are connected to baffles 20. That is, here the path 14 feed rollers 13 and their drive motor "M" desirably automatically move with those input and output 15, 16, as shown in phantom in FIG. 1. This is so that if the input 15 goes up while the output 16 goes down, or vice versa, or not, the entire paper path 14 may automatically adjust, incline and become substantially longer than the length of a horizontal (level) paper path connection through the UIM 10, and also vertically reposition. Thus, a lightweight sheet path 14 and motor M is desirably provided for ease of path 14 adjustment, and module 10 stability.

The increase A' in the path 14 length, as that path 14 inclines, is the square root of the sum of the squares of the UIM 10 width A and the then-selected entrance to exit 15 minus 16 height differential B; minus A (since A is also the minimum (horizontal) path length). This increase A' in path length can be substantial. However, it is transparent to the user, since it is automatically provided.

It may be seen that the relative and maximum increase or difference A'-max (between the minimum A and maximum A+A' path 14 length) increases for a narrower UIM 10. Yet, the UIM should be as narrow as possible, to save overall office space and allow more machine locations to be used. The designed width and height of the UIM module thus may vary depending on the maximum extent of the height differences it must accommodate. However, the manufactured UIM width is desirably a single constant width of preferably less than about 40 cm (16 inches) or so, and preferably only about 30 to 40 cm in width. That allows the UIM 10 to still be self-standing (relatively stable), but adds little overall length to the units it interconnects. Thus, the path 14 length varies greatly depending on the input-/output entrance 15, 16 level differential.

This change in path 14 length may also affect the desired number of sheet feeding nips in path 14. More and closer drive rollers 13 may be provided, especially if it is desired to positively feed through small (in the feeding dimension) sheets, such as envelopes fed in long-edge first or landscape orientation. That way the path 14 may desirably accommodate a full range of sheet products as well as accommodating a maximum extension of the path 14 length (when the input and output 15, 16 are furthest apart) without losing positive sheet feeder 13 nip engagement.

A standard UIM 10 height of about 92 cm. (36 inches) may be used. If desired, the UIM top cover may pivot up (and be retained up) at at least one side together with that end of the paper path 14, to increase its height range on that side, and/or for jam clearance or repair access.

One example of optional means to fully enclose the UIM 10 yet allow the desired unimpeded path repositioning movement is also noted. One or both of the sides of the UIM 10 having the end unit 15, 16 may be connected to (above and below the sheet entrance slot) a flexible, heavy plastic or tambour curtain wall or "windowshade," respectively. As the end units 15 or 16 reposition, their connected said "windowshades" can automatically unroll and roll up on spring loaded rollers at the top and bottom of unit 10. The respective side edges of these windowshades may be slideably supported in channels or tracks in the UIM 10 frame. Thus, the input and output sides of the UIM 10 can remain safely enclosed at all times irrespective of the repositioning of input and/or output levels thereon. Of course, a side of unit 10 docked directly adjacent a sidewall of a unit 11 or 12 is blocked thereby, and does not need its own sidewall. The motor M can also be interlocked not to run unless so docked.

To readily accommodate or match UIM sheet feeding speed to the print engine output, a variable speed motor "M" driving the sheet feed transport path 14 rollers 13 is desirable. It may be speed controlled by a tachometer feedback system, or the feeding speed may be set by the installer, or automatically set from a conventional sheet path sheet edge sensor 25 or 26 at the incoming sheet input side (15 or 16) of the UIM, which can detect the time between incoming sheets in a conventional manner. The sensors 25, 26 may also conventionally provide sheet jam sensing, by monitoring the sheet feeding time from one sensor at one end of path 14 to the other. The sensors 25, 26 may be conventionally connected to a conventional programmable controller 100, as shown in FIG. 3. Controller 100 can also provide speed and reversibility control for drive motor M.

This input sensing by sensors 25 or 26 can also be used to automatically reverse the sheet feeding direction for left or right paper input feeding. Although as noted below, the reversal of UIM sheet feeding direction could alternatively be accomplished by reversing the unit, a drive belt, or some other modification at installation, a single variable speed/reversible motor M accomplishes both functions.

That is, to be fully "universal", to accommodate printers with either right side or left side sheet outputs, as well as any output level, the sheet feeder path 14 through the UIM 10 is desirably easily reversible. As conventionally viewed from the front, if the UIM is operatively connecting to a left side or end output of a printer (to feed sheets to a left-side connected sorter, mailbox, finisher or other output processor), the feed path 14 rollers or belts are driven so that the UIM 10 feeds sheets from right to left through the unit. For operatively connecting to the right side or end of a printer, the unit feeds sheets from left to right. This can be provided by the reversible drive motor "M" reversing the feed rollers 13. The motor M reversal can be by an installer or operator switch therefor. Or, as noted, motor M direction can be automatically switched by sensing which sheet sensor 25 or 26 is first activated.

However, reversal could also be provided by a clutch or reversible belt drive easily changed by the tech rep or machine installer at the time of installation. E.g., a drive belt between the drive motor "M" and its driven feed rollers 13 may be re-mounted in a "figure 8" path rather than the normal belt loop path to provide drive reversal in a known manner.

For bi-directional feeding, the baffles 20 are designed not to catch or stub sheet edges in either direction, even at a telescoping or sliding overlap area. This can be done by interdigitating baffle fingers or extensions mating with turned-down ends with baffle cut-outs or notches, in a known manner, or otherwise. A type of telescoping "tongue and groove" baffle 20 is shown here which is bi-directional. The feed rollers 13 are shown driven by a belt tensioned by a movable "dancer roll" to accommodate the sheet path 14 length changes and maintain driving of the rollers 13 at the ends of the path 14. If desired, these end rollers 13 may also have an adjustable nip orientation, as shown in phantom in FIG. 4. As also shown, (especially FIGS. 1 and 3) the (top) idler roll of the central roller 13 may be pivotally mounted to lift up for jam clearance.

Alternatively, the UIM can be designed to be installed in mirror image. That is, with the UIM being front to back reversible, so as to reverse both the paper path feed direction and the sheet input and/or output in that manner. In that case, the sheet feed path therethrough can be conventionally unidirectional. This reversibility can be provided by a unit 10 rear cover attractive enough in appearance to be used as the unit 10 front cover; or front and rear covers which can be easily removed and interchanged. This has the added advantage of only requiring a printer 12 output level adjustment range on one (consistent) side of the unit 10, and only the desired output device 11 input height range on the other side of the unit 10, rather than providing the maximum range for either on both sides.

Another optional feature of an interface unit 10 is to provide optional additional on-line sheet treatment subsystems in the UIM module sheet path itself, or in an input path thereto, or in various inter-connected output devices 11, or combinations thereof. These functions can include, for example, a sheet rotator, sheet inverter, sheet hole punch, signature folder, Z-folder, sheet inserter, purge tray, etc., or combinations thereof. These are all well known, per se, and need not be shown in detail here. They may be located in a removable and replaceable sub-module, so as to be able to easily meet various customer needs by easily substituting one such functional unit or sub-unit for another.

For example, in general sheet rotators operate by moving one side of the sheet faster than the other, by holding or much more slowly feeding the sheet in one sheet feed nip on one side of the feed path than the other (as with a variable speed motor or drive) until the sheet rotates 90 degrees. Thus allows a choice of sideways or end-wise sheet bin or tray finishing and/or stacking, such as selection of the side of the copy set to be stapled. Sheet rotators are shown, for example, in U.S. Pat. Nos. 5,090,638; 3,861,673; 4,473,857; 4,830,356 and 5,145,168; and some of them are shown in interface modules.

If a large, e.g., 17 inch, sheet is signaled by the printer 12 as being sent, or detected by UIM sheet path sensors, such as 25, 26, then such a sheet can be rotated by a sheet rotator in the sheet path as described above, so as to ultimately stack short-edge first in an output unit 11 bin. Alternatively, if a sheet folder is provided in the sheet path, the large sheet can be folded before stacking. Thus, the sorter or mailbox bins need not be oversized just to accommodate such abnormal large size sheets.

As further examples of on-line reproduction machine output sheet processing units and functions, EK U.S. Pat. No. 4,602,775 and Fuji Xerox U.S. Pat. No. 5,172,162 show an interface module with an inverter or other sheet processor between a printer or copier and a sorter, finisher, or other output unit. Examples of on-line Z-fold and other sheet folder systems are in U.S. Pat. No. 5,026,556 issued Dec. 31, 1991 to B. P. Mandel. Examples of on-line sheet hole punching units include Xerox Corporation U.S. Pat. No. 4,819,021; and U.S. Pat. Nos. 4,998,030 and 4,763,167. Examples of sheet inverter patents include Xerox Corporation U.S. Pat. Nos. 3,833,911; 3,917,257; 4,359,217; and 4,673,176. The first two show an optional inverter in association with a sorter, as in the Xerox Corporation "4500" copier. Examples of cover or other sheet inserters, etc., are disclosed in the Xerox XDJ publication of November/-December 1991, pages 381–383; and U.S. Pat. Nos. 4,626,156; 4,924,265; 5,080,340; and 4,602,776. Sheets may be fed from various sheet trays and feeders at times selected by the printer or controller to be interposed (interleaved) with job sheets from the printer going into the same sheet path to the same stacker and/or compiler/stapler.

Note that if sheet path side registration is desired in the disclosed UIM sheet path 14, (or before or after) that can also be provided. Examples of sheet feeding side registration systems and hardware include Xerox Corporation U.S. Pat. Nos. 4,487,407; 4,411,418; 4,621,801; 4,744,555; 4,809,968; 4,919,318, and 5,065,998.

Another possible option is a selectable face up or face down inverter/stacker. One example is in an allowed Xerox Corporation U.S. Pat. Nos. 5,201,517, issued Apr. 13, 1993 to Denis Stemmle, D/89465, "Orbiting Nip Plural Mode Sheet Output with Faceup or Face-down Stacking".

Note that the sheet processing output modules 11 can also provide an alternate, gated, by-pass sheet feeder path on through the module or unit 11 into another unit 11 for increased bin capacity or further such sheet processing options, as is well known for ganged sorter units.

Alternatively, as shown in FIG. 3, for example, another UIM 10 can be used to operatively connect between two units 11, such as a finisher unit and a mailbox and/or stacker unit. Or, a UIM 10 may be used at a printer 10 input to connect a high capacity sheet feeder to a printer clean sheet input.

The UIM can thus connect with or provide interposer functionality for a host of paper handling accessory features or systems such as: finishers (staplers stitchers, glue binders, etc.), cover or tab inserters, sheet inverters or rotators, hole punches, sheet folders (center, signature, or "Z-fold"), hicap feeders, slitter/perforators, booklet makers, etc.. A multitude of other post processing options can also be employed in or on the UIM, or in units it provides sheet feeding connections to, such as: MICR tape stamping [e.g., as in Xerox Corporation U.S. Pat. No. 5,083,157], Color foil/holographic foil application, UV ink annotation, Bar codes for scanning, MICR for magnetic reading, etc.. [Note, e.g., the cited U.S. Pat. No. 5,083,157; and U.S. Pat. No. 5,178,162 "Apparatus for Connecting an Image Recording Device to a Sheet Processor".]

dereiv as a few examples of existing commercial utput devices presently employing separate and unique nterfaces which could all be replaced by one UIM are he: Xerox DT135/BOURG SBM with dual output eight of 1021/860 mm, now accommodated by a nique left to right transition module; the 9790 MICR-BOWE-SYSTEC inserter with unique input transport elevating Xerox "9790" duplicator output from 940 mm to over 1100 mm right to left; and the Xerox "4135"/Bell & Howell "Mailstream" with a bypass transport moving 4135 output from 1418 mm to 860 mm left to right. Also, the Xerox "DocuTech" 135 Signature Booklet Maker, which adapts to "5090"/DT135, 860 mm and 1021 mm output heights, but is not adjustable nor adaptable to other copier/printer outputs. They are all somewhat adjustable, for floor level/mismatch etc., but are all for a specific printer output to a specific finishing application in height and direction.

While the embodiment disclosed herein is preferred, it will be appreciated from this teaching that various alternatives, modifications, variations or improvements therein may be made by those skilled in the art, which are intended to be encompassed by the following claims:

What is claimed is:

1. A universal interface for operatively connecting and feeding the sequential copy sheet output of various selectable reproduction machines widely varying ranges of sheet output level heights and direction to various selectable independent copy sheet processing units having widely varying sheet input level heights, comprising:

a free-standing movable universal interface module of a fixed narrow width;

said narrow free-standing universal interface module providing a repositionable sheet feeding path therethrough, from one side to the other of said module, for transporting said copy sheet output of said selected reproduction apparatus to said sheet input of said selected copy sheet processing module;

said repositionable sheet feeding path through said universal interface module including integral vertically repositionable sheet receiving or sheet discharging sheet path ends opening at opposite sides of said interface module, which sheet path ends are readily independently repositionable over a large vertical height range;

a retention system for retaining said sheet path ends at selected height positions mating with a selected reproduction apparatus sheet output level and a selected copy sheet processing unit sheet input level so that said repositionable sheet feeding path is operatively connecting therebetween to feed sheets from said reproduction apparatus to said copy sheet processing module;

wherein said repositionable sheet feeding path through said universal interface module provides selectably reversible feeding of said copy sheets therethrough in either direction.

2. The universal interface of claim 1, wherein said repositionable sheet feeding path has a variable path length varied automatically with said path ends vertical height repositioning.

3. The universal interface of claim 1, wherein said sheet feeding path through said interface module remains substantially linear irrespective of said sheet path ends vertical height repositioning.

4. The universal interface of claim 1, wherein said universal interface module has a constant width of less than about 40 cm.

5. The universal interface of claim 1, wherein said sheet path ends of said interface module sheet feeding path are vertically repositionable over a vertical height range of at least approximately 50 to 100 cm.

6. The universal interface of claim 1, wherein said sheet feeding path has an automatically reversing sheet feed drive.

7. The universal interface of claim 1, wherein said repositionable sheet feeding path has a variable path length varied automatically with said path ends vertical height repositioning and wherein said sheet feeding path is defined by telescoping baffles automatically telescoping to provide changes in said sheet feeding path length.

8. The universal interface of claim 1, wherein at least one of said vertically repositionable sheet receiving or sheet discharging sheet path ends opening at opposite sides of said interface module has an adjustable sheet input angle to match the mating sheet output angle from said copy sheet output of said selected reproduction apparatus.

9. The universal interface of claim 1, wherein at least one of said vertically repositionable sheet receiving or sheet discharging sheet path ends opening at opposite sides of said interface module has an adjustable sheet input attitude to match the mating sheet output angle from said copy sheet output of said selected reproduction apparatus comprising a pivotal angle input baffle.

* * * * *